United States Patent [19]

Chawla et al.

[11] Patent Number: 4,643,097

[45] Date of Patent: Feb. 17, 1987

[54] SHAPED CHARGE PERFORATING APPARATUS

[75] Inventors: Manmohan S. Chawla, Houston; William A. McPhee, Jersey Village, both of Tex.

[73] Assignee: Dresser Industries, Inc., Dallas, Tex.

[21] Appl. No.: 791,633

[22] Filed: Oct. 25, 1985

[51] Int. Cl.[4] ..... F42B 1/02

[52] U.S. Cl. ..... 102/306; 102/307; 102/309; 102/476

[58] Field of Search ..... 302/305, 306–310, 302/476, 494, 495, 506

[56] References Cited

U.S. PATENT DOCUMENTS

| | | | |
|---|---|---|---|
| 3,021,784 | 2/1962 | Meddick | 102/306 X |
| 3,967,553 | 7/1976 | Keraus et al. | 102/476 X |
| 4,057,001 | 11/1977 | Valentine | 102/494 X |
| 4,080,898 | 3/1978 | Gieske | 102/306 |
| 4,220,687 | 9/1980 | Christopher | 428/546 |
| 4,387,773 | 6/1983 | McPhee | 175/4.6 |
| 4,428,440 | 1/1984 | McPhee | 175/4.6 |
| 4,513,666 | 4/1985 | Segletes | 102/307 X |
| 4,519,313 | 5/1985 | Leidel | 102/307 X |

*Primary Examiner*—Peter A. Nelson

*Attorney, Agent, or Firm*—Patrick H. McCollum

[57] ABSTRACT

A shaped charge perforating unit includes a housing having a cavity formed therein. An explosive charge of high explosive material is retained within the cavity by a liner of non-explosive material. The exterior of the housing is substantially surrounded by a porous jacket of high strength fiber material.

6 Claims, 1 Drawing Figure

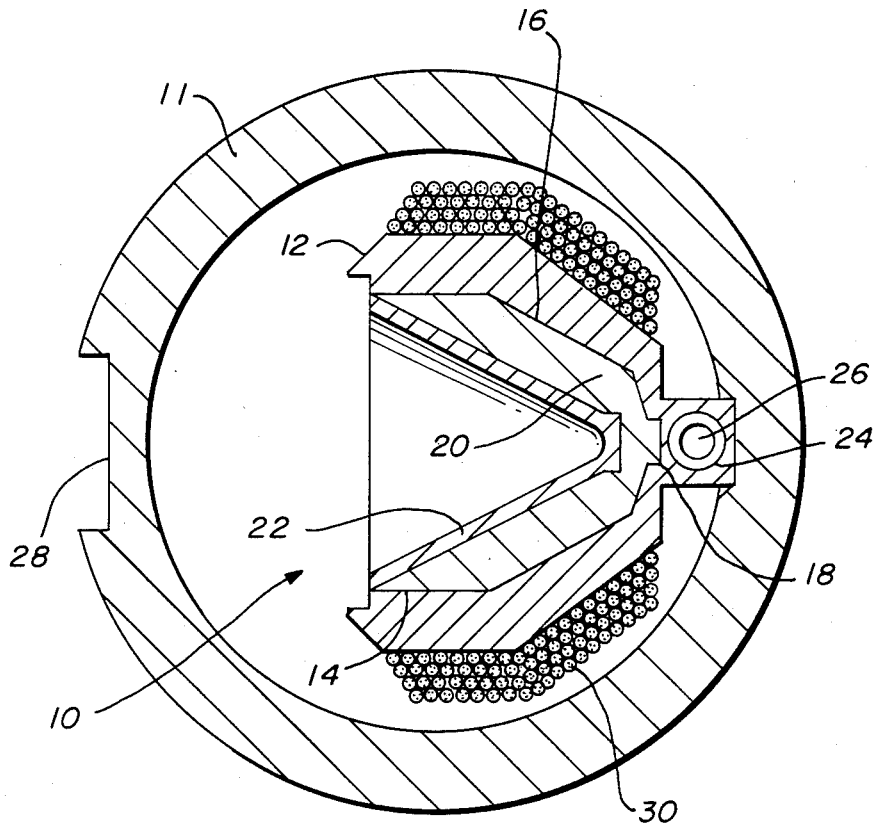
16
11
12
26
24
20
22
28
18
14
10
30

SHAPED CHARGE PERFORATING APPARATUS

BACKGROUND OF THE INVENTION

This invention relates in general to oilfield perforators and more particularly, to an energy absorbing device used in conjunction with a shaped charge perforating device to lessen physical damage to a gun body housing upon detonation of the charge.

Explosive shaped charge well perforating devices are often used in perforating well casing and the surrounding earth formations in the production of hydrocarbons. In a typical embodiment, a plurality of shaped charges are mounted in a fluid-tight, cylindrical, metal housing or on an elongated bar member which is adapted to traverse the borehole to be perforated. The shaped charges are mounted in the housing or on the bar member at longitudinally spaced intervals, with their axis of perforating directed generally laterally thereof. A more detailed description of a typical perforating apparatus is contained in U.S. Pat. No. 4,428,440, which is incorporated herein by reference.

The shaped charge most common in well perforating is a conical shaped charge. A conical shaped charge consists of an explosive material having a substantially conical cavity formed in the front face. A metal liner material covers the face of the cavity. Upon detonation the shape of the explosive cavity focuses and propagates a progressive wave front against the outside surface of the metal liner. At the pressures generated the metal acts as a fluid. Metal in fluid form is focused into a "jet" stream. The resultant focusing force moves particles to form a jet which lengthens as the wave front advances from apex to base of the conical cavity. The extreme high pressure, particle laden, jet stream breaks down and moves aside any material upon which it impinges. Penetration of such material is a result of the amount of pressure and the kinetic energy in the jet stream. One form of conical shaped charge used in well perforating is illustrated in U.S. Pat. No. 4,387,773, which is incorporated herein by reference.

Oil well shaped charges typically are enclosed in a metal charge case. The relative weight of the case provides an inertial backup for the explosive energy and serves to reflect a portion of the energy back toward the charge liner. Unfortunately, the cases that meet the weight and space requirements of the perforating gun device are not fully effective in absorbing or reflecting all of the explosive energy. The charge case under the explosive action may expand and eventually break-up. The resulting debris scatters within the gun body. While the present perforating gun bodies function to keep the debris from being deposited within the well, they tend to deform under the explosive forces of the detonation process. If these forces are excessively large it can result in excessive swelling, fracturing and/or severing of the gun body. Thus, two factors contribute to gun body damage: (1) high velocity debris from the shaped charge case impacting the gun body interior, and (2) the blast wave caused by detonation of the shaped charges.

These and other disadvantages are overcome with the present invention by providing method and apparatus for perforating a well casing and the surrounding formations using a lined shaped charge employing protection against both the explosive blast wave and charge case debris.

SUMMARY OF THE INVENTION

A shaped charge perforating unit comprises a charge case or housing with an internal cavity formed therein. An explosive charge of high explosive material conforms an exterior shape with the inside of the cavity and is retained in place by a liner of non-explosive material. The exterior of the shaped charge case is substantially surrounded by a porous jacket of high strength, heat resistant fiber material to minimize the explosive forces and reduce charge case debris.

BRIEF DESCRIPTION OF THE DRAWING

The FIGURE is a longitudinal, cross-section of a shaped charge unit in accordance with the present invention.

DETAILED DESCRIPTION OF A PREFERRED EMBODIMENT

Referring now to the FIGURE, there is illustrated a lined shaped charge unit 10 adapted for use in a perforating gun 11 for perforating oil well casing and the surrounding formations. The housing or shell 12 may be made of any suitable material, such as, for example steel. Housing or shell 12 may have any one of numerous outside configurations as is common in the art, for example a generally uniform outside diameter or a frustoconical appearance.

The cavity formed in the interior of housing 12 may be conical, hemispherical or other suitable configuration. As illustrated in the FIGURE, the cavity has a generally cylindrical forward end portion 14, a tapered, intermediate portion 16 and an apex with a reduced rear end extension 18. The explosive charge comprises a tubular or annulus shaped body of high explosive material 20, conforming in exterior shape with the shape of the inner surface of the cavity formed within housing 12. A liner 22 retains the explosive charge within housing 12. Liner 22 is illustrated as conical in shape, however, it should be recognized that it could be of other suitable shapes, for example hemispherical. Liner 22 is constructed of a suitable non-explosive material, preferably having a relatively high density, such as, for example copper.

The rear of housing 12 is formed with a traverse opening or passage 24 adjacent the rear portion of the explosive material into which may be located a detonating fuse 26. An area of reduced thickness 28 is formed in perforating gun 11 substantially in alignment with the axis of symmetry, the perforating axis, of the shaped charge unit.

Surrounding the exterior of housing 12 is protective jacket 30. Jacket 30 is constructed of a high strength fiber. More specifically, jacket 30 is constructed of a high strength continuous filament yarn having high temperature characteristics and a high modulus, such as an aramid fiber. Example's of such fibers are those manufactured by DuPont Corporating and marketed under the trademarks Kevlar and Nomex. Jacket 30 can be formed by weaving the fiber into a configuration having a uniform cross weave or adhering several layers of fabric into a cross weave and forming the jacket into the shape of the housing exterior. Another alternative is to tightly wrap the fiber about the circumference of the housing in a bobbinlike fashion.

In the operation of the invention, detonator fuse 26 is detonated by an ignitor or blasting cap (not shown). Detonator fuse 26 will detonate explosive material 20.

A detonation wave thus caused travels forwardly and strikes the apex of liner 22. The wavefront continues to travel forwardly through the main explosive material section, simultaneously collapsing liner 22 symmetrically inwardly about the axis of liner 22 causing the inner surface of liner 22 to flow and form part of a jet stream. The liner material upon arrival at the axis of symmetry separates into a fast moving jet carrying most of the particles.

The explosive forces generated by the detonation of explosive material 20 causes housing 12 to expand placing fiber jacket 30 under tension. Jacket 30, due to its high tensile strength, resists the expansion of housing 12, reducing breakage thereof. Further, should fragmentation occur the high tensile strength of the fiber helps to conduct the kinetic energy caused by impact of debris away from the impact points. Kinetic energy of the debris is uniformly distributed by the entire jacket 30 and is dissipated. This serves to reduce the velocity of the debris further reducing the potential of damage to the perforating gun body. Jacket 30 also serves to reduce the blast wave due to collapse of the void space of jacket 30.

May modifications and variations besides those specifically mentioned may be made in the techniques and structures described herein and depicted in the accompanying drawing without departing substantially from the concept of the present invention. Accordingly, it should be clearly understood the form of the invention described and illustrated herein is exemplary only, and is not intended as a limitation on the scope of the present invention.

The embodiments of the invention in which an exclusive property or privilege is claimed are defined as follows:

1. An explosive shaped charge comprising:

a housing having a forwardly opening cavity formed therein;

a quantity of explosive material within said cavity;

a liner cooperatively arranged to retain said explosive material in said cavity; and a jacket of fiber material substantially surrounding said housing.

2. The shaped charge unit of claim 1 wherein said jacket of fiber material comprises a fiber having high temperature characteristics and a high tensile strength.

3. The shaped charge unit of claim 1 wherein said jacket of fiber material comprises a continuous filament yarn.

4. The shaped charge unit of claim 3 wherein said jacket of fiber material comprises an aramid fiber.

5. An explosive shaped charge unit for use in perforating subsurface earth formations comprising:

a hollow charge casing;

a shaped charge liner;

an explosive charge material coaxially disposed between said charge casing and said charge liner; and at least one layer of high temperature, high strength textile fiber material substantially surrounding said charge casing.

6. The shaped charge unit of claim 5 wherein said fiber material comprises a continuous filament yarn.

* * * * *